US006062274A

United States Patent [19]

Pettesch

[11] Patent Number: 6,062,274

[45] Date of Patent: May 16, 2000

[54] VAPOR REDUCTION IN FILLING FUEL STORAGE TANKS

[75] Inventor: Martin C. Pettesch, Cranford, N.J.

[73] Assignee: Universal Valve Co., Inc., Elizabeth, N.J.

[21] Appl. No.: 09/268,361

[22] Filed: Mar. 15, 1999

[51] Int. Cl.[7] ..... B65B 1/04

[52] U.S. Cl. ..... 141/1; 141/198; 141/302; 141/305

[58] Field of Search ..... 141/1, 192, 198, 141/301–303, 305, 307, 308; 220/567.1, 567.2, 86.1; 137/447, 448

[56] References Cited

U.S. PATENT DOCUMENTS

| | | | |
|---|---|---|---|
| 5,207,241 | 5/1993 | Babb | 137/447 |
| 5,299,605 | 4/1994 | Bergamini et al. | 141/59 |
| 5,485,866 | 1/1996 | Bowen | 137/554 |
| 5,564,465 | 10/1996 | Pettesch | 137/447 |

FOREIGN PATENT DOCUMENTS

| | | | |
|---|---|---|---|
| 0327518 | 9/1989 | European Pat. Off. | B67D 5/06 |
| WO9007966 | 2/1990 | WIPO | B01D 19/00 |
| WO9638375 | 5/1996 | WIPO | B67D 5/58 |
| WO9842615 | 1/1998 | WIPO | B67D 5/58 |

OTHER PUBLICATIONS 2 page sales bulletin, EBW, Dated Mar. 29, 1999, Form #8224 Nov. 1998, Bulletin #0399–02.

*Primary Examiner*—Steven O. Douglas
*Attorney, Agent, or Firm*—Edward Dreyfus

[57] ABSTRACT

A fuel storage tank with reduced vapor generation capability having a drop tube with a pressure activated valve in the wall of the drop tube to permit communication between the inside upper region of the tank and the inside of the drop tube. The valve is normally closed to prevent vapors in the tank from being sucked into and entering the drop tube. A buildup of vapor pressure in the upper drop tube region causes the valve to open and the air/vapor to flow from the upper drop tube region into the upper storage tank region. No special pipes, lines, floats or other apparatus are needed for this vapor reduction arrangement and method and any air or vapor originally entering the riser or initially in the drop tube that flows into the tank upper region is handled in the conventional manner as all other vapor originally in that region, i.e. it is recycled and recovered in the top of the tanker delivery truck.

12 Claims, 5 Drawing Sheets

VAPOR REDUCTION IN FILLING FUEL STORAGE TANKS

BACKGROUND

The present invention relates to volatile liquid storage tanks and more particularly to such tanks having apparatus for reducing vapor generation when the tank is filling from the upper or top side of the tank. These tanks could include above and below ground petroleum fuel tanks, chemical storage tanks, mobile liquid storage containers, and the like. Although the focus of this description will be on below ground fuel storage tanks, the invention has application with other tank types as well.

Riser pipes are used as the main liquid fill lines for fuel storage tanks located below ground at gasoline service stations and the like. The riser pipe is vertically oriented, has its upper end located in a manhole, and its lower end opening towards the inside of the below-ground storage tank. Because it is important to fill fuel storage tanks from the bottom of the storage chamber, drop tubes are inserted through the riser and have their outlet ends positioned near the bottom of the storage chambers. Risers and drop tubes must be dimensioned to accommodate a flow of approximately 340 gallons per minute.

Drop tubes function to confine the inflow of liquid until the inflow exits the bottom of the tube near the bottom of the tank. This action serves to essentially fill the tank from the bottom so that liquid is released into the tank under or below the liquid level already stored in the tank. This action reduces turbulence and unwanted vapor generation above the stored liquid level. However, it is known that vapors, a vapor/air mixture, or other or non-liquid fluids (hereafter collectively and severally "vapor") substantially fill the drop tube above the stored liquid level.

In addition, the delivery hose coupled between the tanker truck fill coupler and the top of the riser and the riser itself are substantially completely filled with air when the filling operation begins.

The operator initiates liquid fill by simultaneously opening the tanker foot valve and fill coupler valve which causes fill liquid to drain by gravity from the chosen tanker compartment into the delivery hose. Because of the high rate of flow through about a four inch hose, the flow acts as a rushing wall forcing the air in the hose and riser down into the drop tube. Because the volume initially occupied by the air in the hose riser and drop tube is reduced to the shrinking space in the drop tube, the vapor pressure in the tube rises rapidly. As filling continues, the trapper air and vapor first slow the flow rate of fill liquid util most of the air vapor is carried down and exits the bottom of the tube where it bubbles up toward the stored liquid surface causing turbulence at the surface and generation of further vapor content which increases the fuel density of the vapor above the liquid surface in the tank. As the tank fills, vapors are drawn out of the top of the tank to equalize vapor pressure and are recovered by recycling them back to the top of the tanker truck storage compartments. If the vapor pressures in the storage and fill system rise beyond permissible limits, safety valves vent the vapor to the atmosphere.

Accordingly, there is a general desire to fill liquid storage tanks in such a way as to reduce or avoid excessive vapor generation and reduce the vapor pressure that restricts early flow of fill liquid.

Attempts have been made to reduce the surface turbulence as described above. For example, UK Patent GB 2,301,347, incorporated herein by reference, describes a below ground gasoline storage tank having an elongated "piccolo pipe" with a series of openings along its length mounted longitudinally within the drop tube and having an upper end communicating with a junction piece at the top of the drop tube. This junction is fluidly connected to the vent stack at the manhole cover via a further connector pipe which attaches in fluid connection to the top of piccolo pipe.

During delivery of liquid product to the tank, according to U.K. patent GB 2,301,347, as the product travels down the tanker hose, the displaced air travels down into internal regions of the drop tube, and into the apertures of the piccolo pipe. Once inside the piccolo pipe, the air/vapor moves up the pipe, into the vent stack and is eventually vented without coming into contact with the liquid stored within the tank.

The foregoing apparatus is not free of technical, cost, and installation problems since it requires a junction and new piping to be laid below ground running from the top of the manhole/riser area to the bottom of the tank venting system. In addition, with this arrangement, high pressure vapors fed from the piccolo pipe are vented to the atmosphere instead of being returned to the tanker fueling compartments as is the practice in the United States. Further, this prior art system requires float valves to shut off the piccolo pipe when the liquid rises to a predetermined tank level in order to prevent liquid overfill or spills. These floats may bind in the tube or otherwise wear out resulting in liquid spills and/or requiring pulling and maintenance of the drop tube.

SUMMARY OF EXEMPLARY EMBODIMENTS OF INVENTION

The present invention avoids the foregoing technical and installation problems and provides a simple, inexpensive, and easily installed drop tube with vapor reduction capability in combination with the conventional tank apparatus.

One example of the drop tube according to the principles of the present invention includes a pressure activated valve in the wall of the drop tube, preferable outside the liquid fill path. The valve is mounted to permit communication between the inside upper region of the tank and the inside of the drop tube. The valve is biased to a normally closed position to prevent vapors in the tank from being sucked into and entering the drop tube. A buildup of vapor pressure in the upper drop tube region greater than a predetermined value causes the valve to open and vapor to flow from the upper drop tube region into the upper storage tank region. Once the drop tube vapor pressure declines or the liquid level in the drop tube rises above the pressure activated valve, the valve closes. No special pipes (piccolo or otherwise), lines, floats or other apparatus are needed for this vapor reduction arrangement and method and any air or vapor originally entering the riser or initially in the drop tube that flows into the tank upper region is handled in the conventional manner as all other vapor originally in that region, i.e. it is recycled and recovered in the top of the tanker delivery truck.

Another feature of the present invention includes providing the vapor reduction valve in a separate vapor reduction section that can be mounted in any suitable location in the upper region of the drop tube. One preferred location is below but near the overfill prevention section and another location is above but near the overfill prevention section, in which case liquid remaining in the riser after fill shut-off can drain into the tank through the vapor reduction valve, if desired. Other features include combining the vapor reduction valve with a tank overfill prevention apparatus in a single section mounted at the upper region of the drop tube and forming an indent or recess in the wall of the vapor reduction section or overfill prevention apparatus and mounting the pressure activated valve in the lower wall of the recess such that the valve opening is outside the liquid flow path in the drop tube.

DRAWINGS

Other and further objects, features, and advantages of the present invention will become apparent with the following detailed description when taken in view of the appended drawings, in which.

DETAILED DESCRIPTION OF EXEMPLARY EMBODIMENTS

Figure 1:
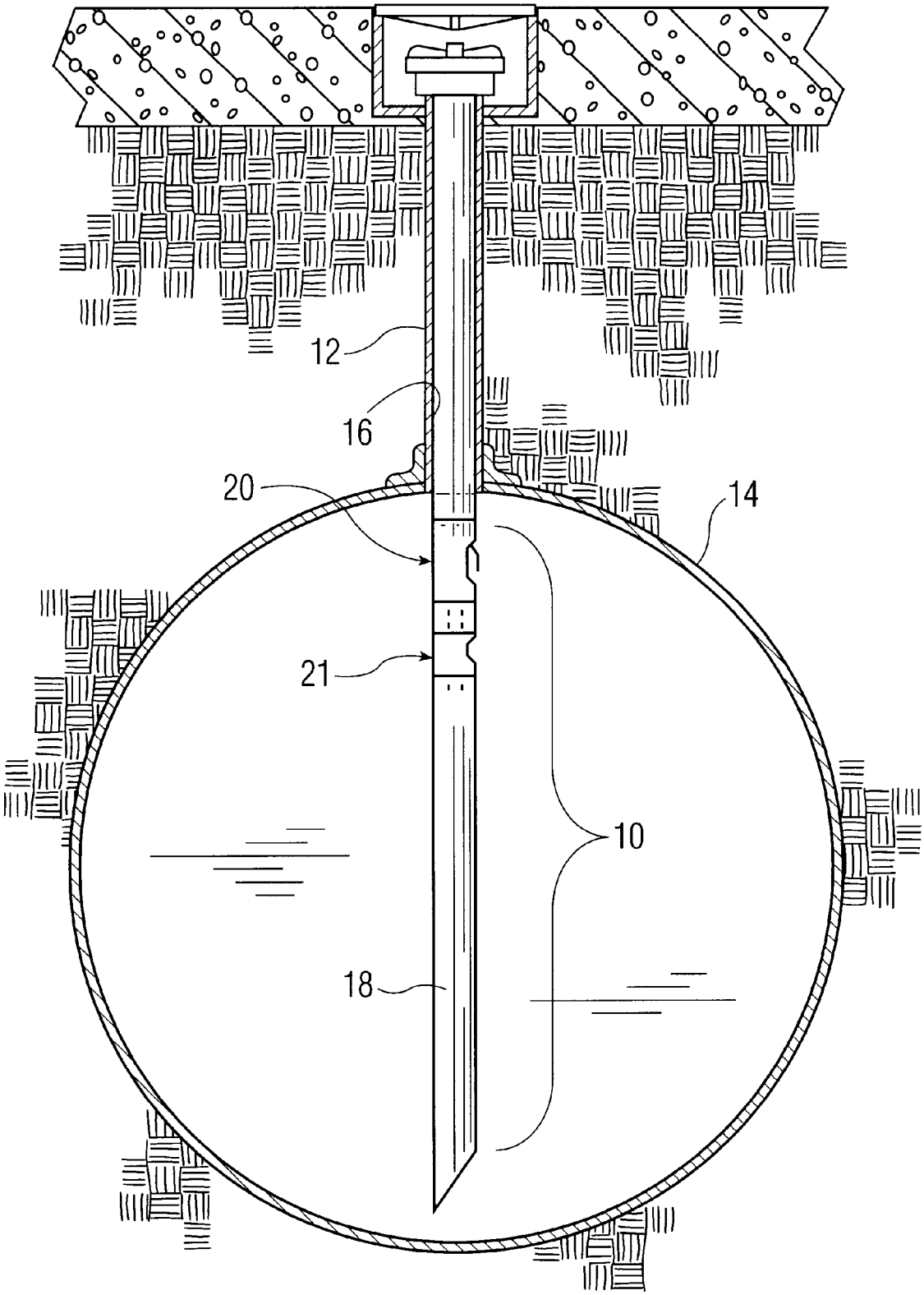
FIG. 1 is a schematic representation of a vertical cross section of a tank, riser pipe and drop tube according to the present invention.

With reference to FIG. 1, one exemplary drop tube according to the principles of the present invention includes drop tube 10 dimensioned to insert through and mount to the bottom of riser pipe 12. Drop tube 10 extends into the interior of volatile liquid, below ground storage tank 14. The outlet of tube 10 opens into and near the bottom of tank 14. Drop tube 10 can include a flow restriction or cut-off section 20 of any known design such as that disclosed in U.S. Pat. No. 5,564,465, incorporated herein by reference, that restricts or closes the liquid flow path to prevent tank overfill when the tank liquid level reaches that region of the tank.

In accordance with the principles of the present invention, tube 10 further includes a vapor reduction section 21 further described below. Section 21 is preferably located below section 20 but can be located above section 20 if desired.

Figure 2:
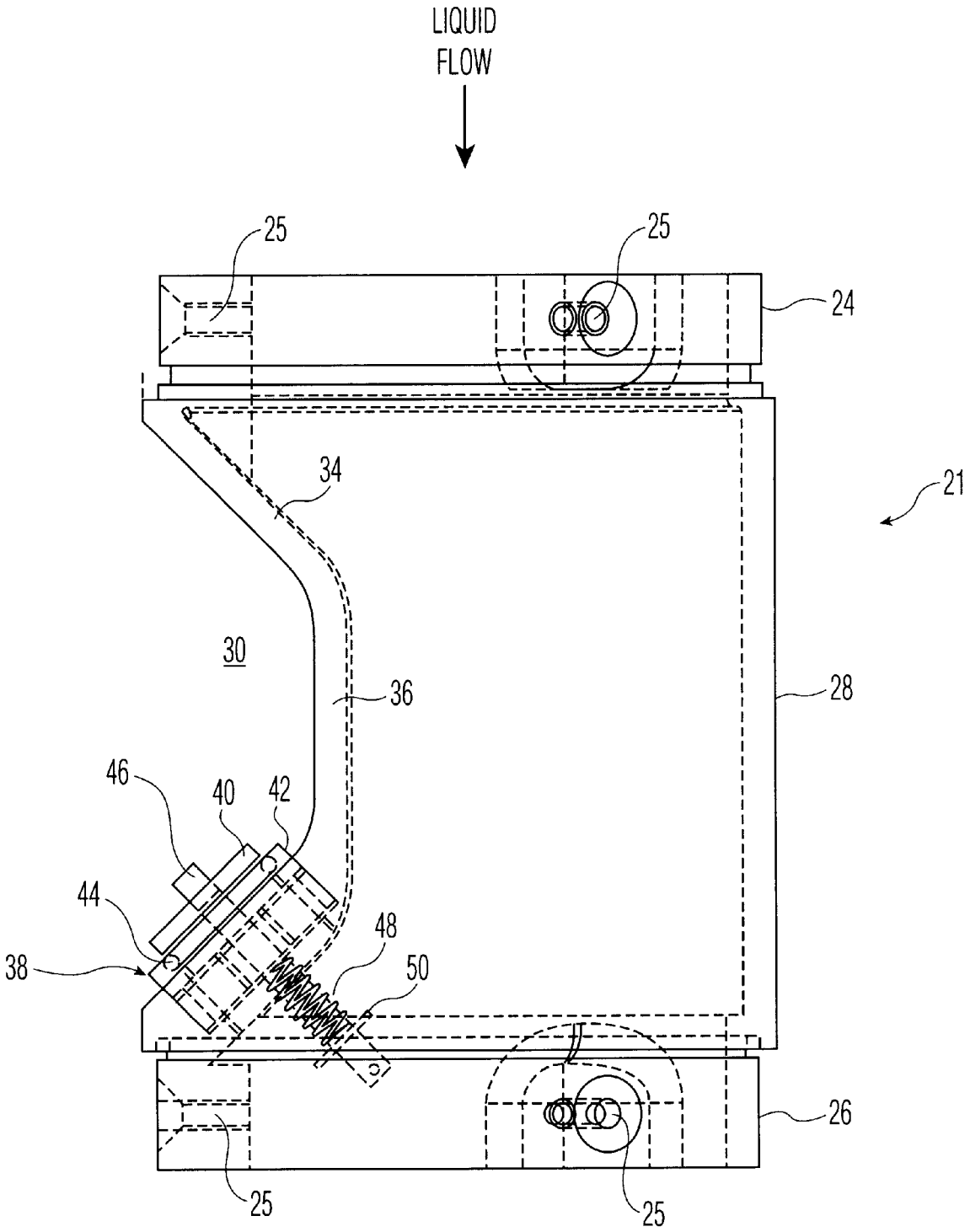
FIG. 2 is a side elevation of the vapor reduction section of the drop tube of FIG. 1.
Figure 3:
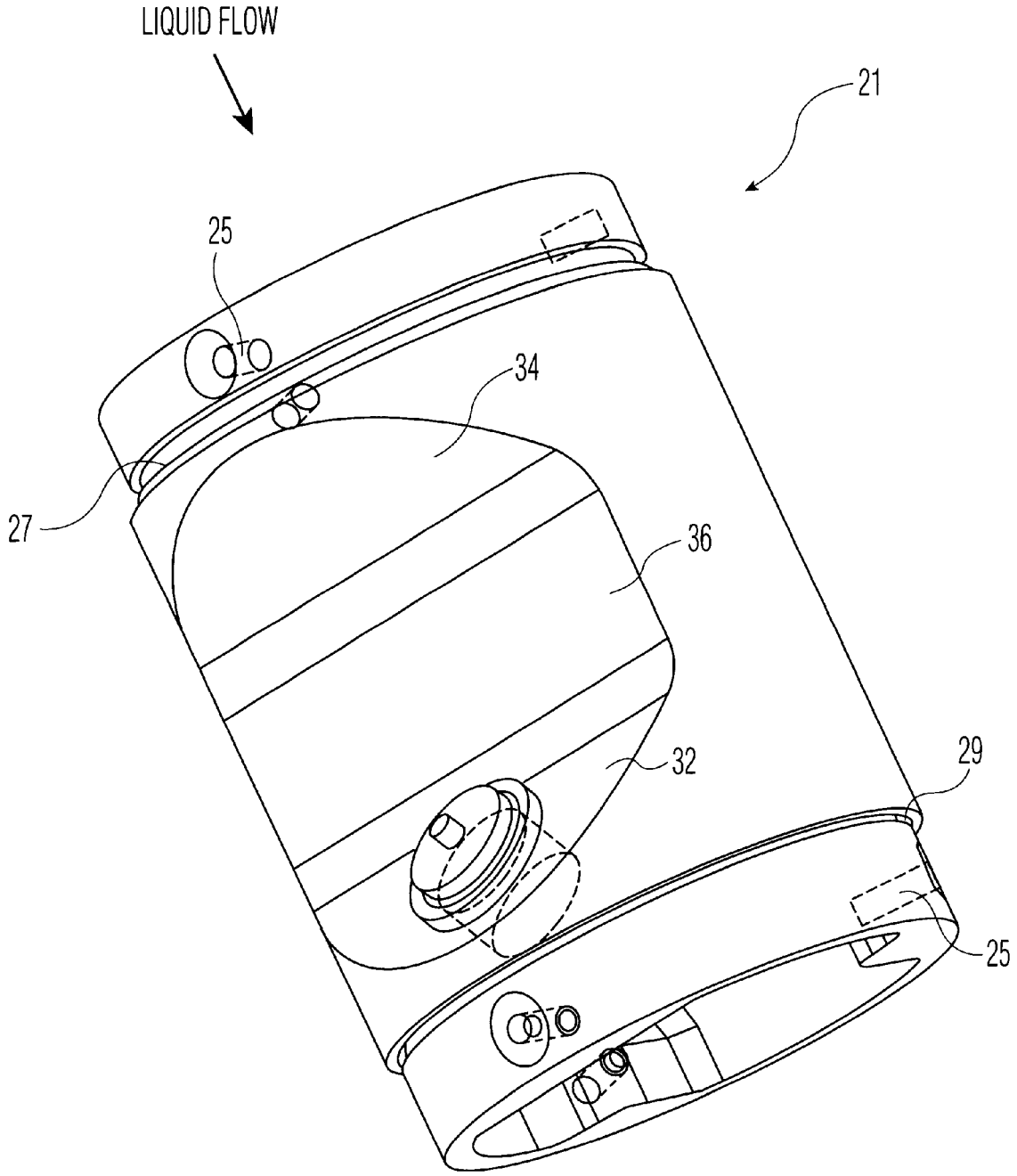
FIG. 3 is a upward perspective of the section of FIG. 2.

With reference to FIGS. 2 and 3, section 21 includes a metal, such as cast aluminum or brass, cylinder having upper 24 and lower 26 ends dimensioned to fit into the standard 4 inch inside diameter of drop tube section 18 and other sections, not shown. Threaded mounting holes are formed in ends 24 and 26 to receive metal screws or bolts (not shown) that secure section 21 axially to other axial sections of the drop tube 10. Preferably, O-ring grooves 27 and 29 are provided so seat O-rings (not shown) to seal section 21 to other parts of the drop tube. The center portion 28 is preferably cylindrical and forms a recess 30 in the profile thereof. Recess 30 preferably includes a bottom upwardly and inwardly sloping wall 32, a top inwardly and downwardly sloping wall 34 and a vertical wall 36. Bottom wall 32 includes a threaded opening to form a valve assembly mount.

A pressure activated valve assembly 38 threads into bottom wall 32. Assembly could be any suitable type, such as the poppet valve type in this example.

Assembly 38 includes poppet valve 40, valve housing 42 that threads into wall 32 and provides a seat for O-ring 44. Poppet 40 is fixed to valve stem 46 that extends through to the section 21 interior. Spring 48, held by washer 50 secured to the inward portion of stem 46, biases poppet 40 to its closed position seating against O-ring 44. Poppet valve 40 remains closed until the positive pressure differential between the vapor in Section 21 exceeds the vapor pressure external to section 21 but inside tank 14 exceeds a predetermined value to overcome spring 48 bias forces and move poppet 40 away from O-ring 44. This action enables vapor to exit section 21 and enter the region inside the top of tank 14. Once the pressures equalize or the section 21 internal pressure drops below a predetermined value, spring 48 closes poppet 40 against O-ring 42 to seal section 21 closed, thus preventing further exhaustion from drop tube 10.

Walls 34 and 36 serve to direct fill liquid and drop tube gauge sticks away from the vertical position of valve assembly 38.

It will be understood that various designs of vapor flow control valves can be suitably used instead of the poppet type valve 40. For example, flexible flap valves, light ball type valves can also be used instead. Although vapor flow control valve is preferably mounted in the bottom wall of a recess, it can also be mounted in the vertical wall of the drop tube, if desired. It is also preferred to vertically align the vapor flow control valve in section 21 and the shut-off valve assembly in section 20.

In operation, when stored tank liquid is low, a tanker truck operator connects a truck fill line or hose to the top of riser 12 (not shown). Even in low condition, the bottom of drop tube 10 is below the stored liquid level. With the onset of fill liquid from the tanker, vapor in the tanker fill line, riser 12 and drop tube 10 is forced into and compressed in the drop tube. As the vapor pressure rises in the drop tube compared to the internal tank vapor pressure, poppet 40 opens permitting compressed vapor to exit into the storage tank upper region. This prevents the trapping of compressed vapor in the drop tube which would otherwise slow or restrict this initial liquid flow. Once the vapor pressure drops below a predetermined level, poppet 40 closes.

As filling continues, because of the vertical free fall of fill liquid, the falling liquid tends to spread vertically near the lower regions of drop tube 10. As liquid flows past section 21, its path is restricted from the profile of recess 30. This creates a liquid void or pocket with negative pressure just below wall 32. Vapor in the upper region of tank 14 can not be drawn into drop tube 10, however, because poppet 40 is closed and sealed against O-ring 44. As the liquid level rises in tank 14, it also rises in drop tube 10. Any remaining vapor in drop tube 10 is therefor compressed in a shrinking free space between the high liquid flow from riser 12 and the rising liquid level in drop tube 10. This action may cause the vapor pressure against poppet 40 in drop tube 10 to rise again. When this pressure, compared to the vapor pressure in the upper tank region, rises to overcome the closing bias of spring 48, poppet 44 opens to permit vapor flow from Section 21 into the tank interior where it mixes with and handled or recycled in the same manner as the originally stored vapor in the tank. When the drop tube 10 vapor pressure falls below a predetermined value, spring 48 closes poppet 44 against O-ring 44 to seal section 21 from the tank interior. This action is repeated so long as the liquid level in drop tube 10 continues to rise and fill liquid enters riser 14. Accordingly, substantial amounts of vapor is exhausted into the upper tank interior instead of being carried down through the bottom of the drop tube, thus reducing drop tube vapor pressure, tank liquid turbulence and related vapor generation quantity within the tank. This action then enables earlier laminar flow of fill liquid throughout the drop tube because of the control of drop tube vapor pressure generally as described, which in turn, saves tanker delivery time.

As the tank liquid level rises above valve assembly 38, valve 40 ceases to respond to vapor pressure and, instead, opens only in response to a positive liquid head pressure. When positive liquid head pressure against poppet 44 rises above the predetermined value, poppet 40 opens to allow liquid flow into tank 14 but below the tank liquid level. Poppet 44 remains open so long as the liquid head pressure against it in drop tube 10 remains above the predetermined value. Once the tank is substantially filled, the overfill prevention section restricts inflow of fill liquid and the operator closes the tanker fill valves. The tanker lines are disconnected and any liquid remaining in riser 12 simply descends slowly through section 20 and section 21. See for example U.S. Pat. No. 5,564,465 incorporated herein by reference. Although the major portion of the air and vapors exit through poppet 40, an insignificant quantity of vapors in the form of trapped small, micro bubbles may exit the bottom of the drop tube. The opened or closed position of poppet 44 is insignificant at this stage of fill.

Figure 4:
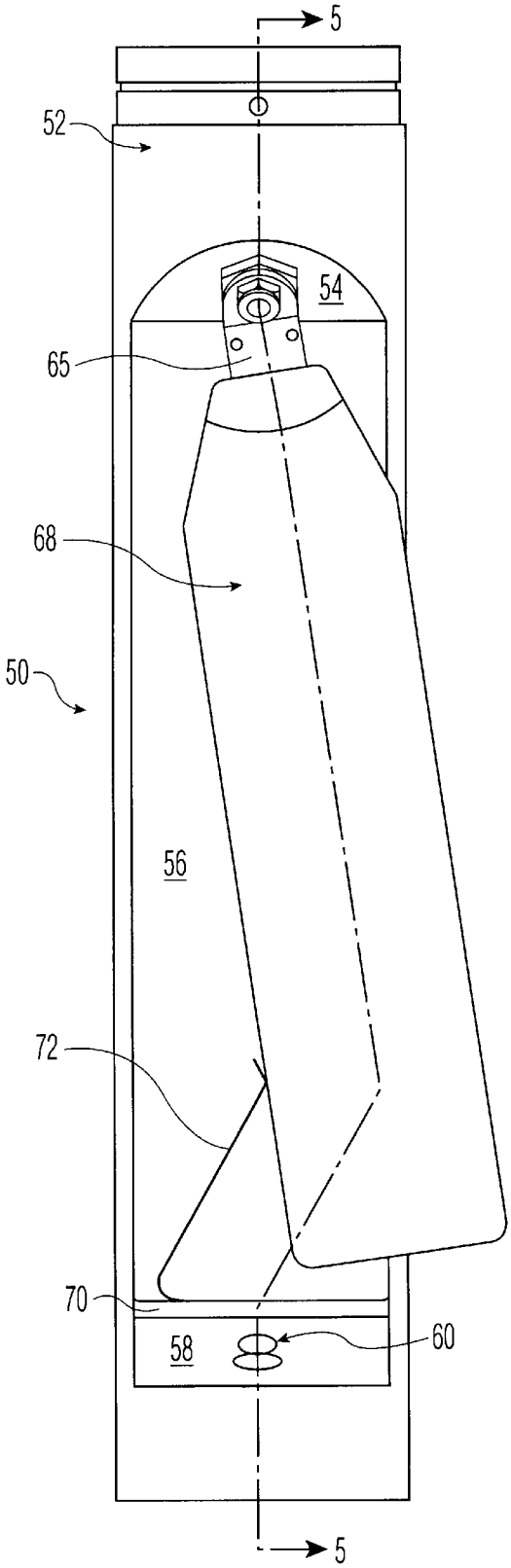
FIG. 4 is a front elevation schematic view of an alternate embodiment of the present invention, specifically, the combined overfill prevention and vapor reduction apparatus.
Figure 5:
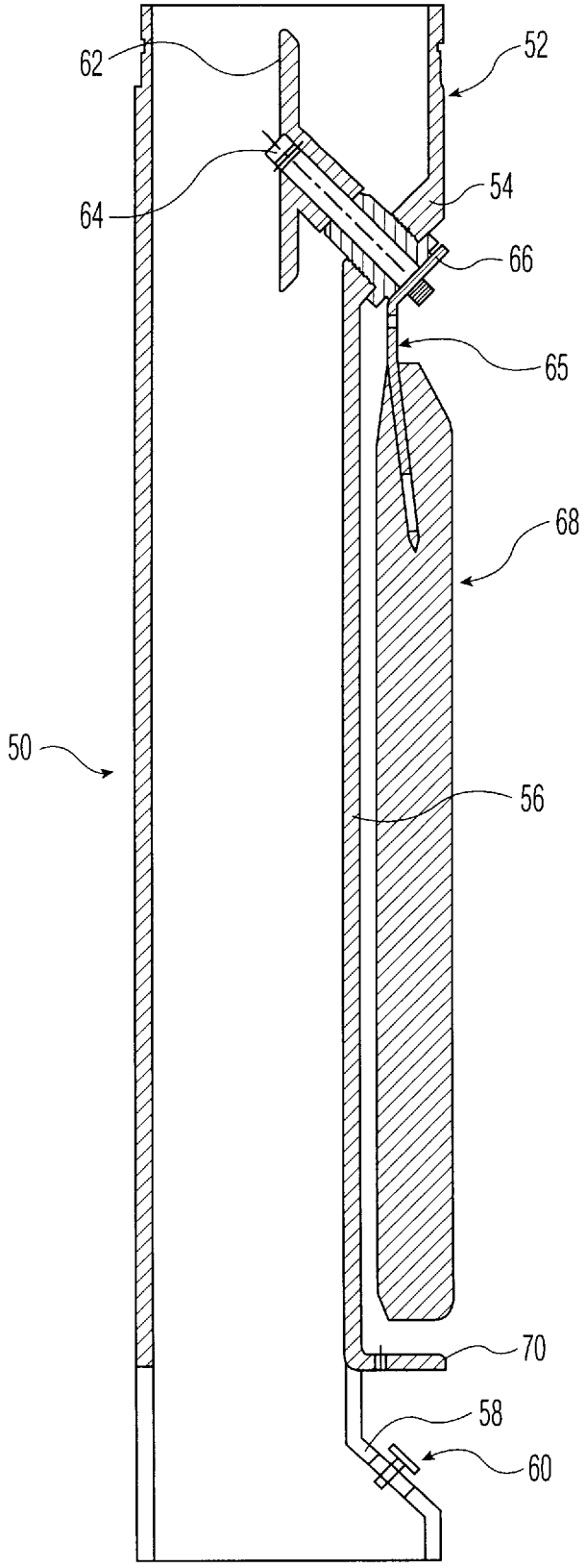
FIG. 5 is a side section view taken along line 5—5 of FIG. 4.

Another exemplary embodiment of the present invention includes a combination overfill prevention apparatus and the vapor reduction apparatus mounted in the same casting with a common recess formed for both the overfill float and the pressure responsive valve assembly. One example of such combination is shown in FIGS. 4 and 5.

Overfill prevention and vapor reduction unit 50 includes an elongated, generally cylindrical body in which walls 54, 56, and 58 form a recess within the horizontal profile of and in a portion of body 52. Pressure activated valve assembly 60 can be mounted in wall 58 or in other suitable parts of body 52 as desired. It will be understood that assembly 60 is shown schematically in FIGS. 4 and 5 and can take various forms and designs, such as the poppet valve assembly shown in FIGS. 2 and 3 hereof. A flow restriction plate or disc 62 has its center region secured to a metal shaft 64 that penetrates and is held for rotation by wall section 54. A metal float bracket 65 includes an angle piece 66 secured to shaft 64. Float 68 can be made of any suitable material such as closed cell nitril rubber ebonite and is secured to the surface of bracket 65 or alternately molded about them. A gauge stick deflection plate (not shown) can be secured to the inside of the section wall above the restriction assembly to deflect gauge stick insertions. It should be understood that the recess and position of the parts enable the drop tube to be inserted or withdrawn from the riser pipe for purposes of installation or repair.

Body 52 further defines a device for holding float 68 slightly off center and slightly toward the closed position when the tank liquid level is below section 50. The purpose is to assure float 68 begins rotating toward the closed position with the rise in liquid level. One example of such device can include lip 70 formed in body 52 that supports a leaf spring 72 mounted thereto by bolts or other devices (not shown). Spring 72 prevents float 68 from assuming a true vertical position whenever the liquid level falls below float 68.

The operation of Section 50 overfill prevention apparatus is described in U.S. Pat. No. 5,564,465. Operation of vapor reduction valve assembly 60 is described above in connection with Section 21 and FIGS. 2 and 3. However, it will be noted that section 50 efficiently houses both apparatus within the same recess of the same casting. This section 50 configuration simplifies installation, reduces the number of drop tube sections that must be fitted together, creates a more functional drop tube with both overfill prevention and vapor reduction capability.

Other and further modifications can be made to the herein disclosed exemplary embodiments without departing from the spirit and scope of the present invention.

I claim:

1. A volatile liquid storage tank comprising a tube located within the tank for directing fill liquid from the top of the tank interior to the bottom of the tank interior, said tube having a portion normally located above the stored liquid level when the tank is to be refilled with volatile liquid, said portion comprising a control valve movable between a normally closed position for preventing vapor flow from the tank interior into said tube when the vapor pressure in the tank interior is greater than the vapor pressure in said portion, and an open position for allowing vapor flow from said portion to the tank interior when the vapor pressure in said portion exceeds the vapor pressure in said tank interior.

2. A tank according to claim 1 wherein said portion comprises a continuous wall, said wall defining a vapor flow path opening, and said control valve closing off the vapor flow path opening when in the closed position and opening the vapor flow path opening when in the open position.

3. A tank according to claim 2 wherein said portion further includes biasing means for biasing said control valve to its closed position.

4. A tank according to claim 2 wherein said wall comprises a wall section defining a recess and said vapor flow path opening is located in said wall section.

5. A tank according to claim 4 wherein said wall section includes an inward and upward sloping lower wall portion and said vapor flow path opening is located in said lower wall section.

6. A tank according to claim 1 further comprising an overfill prevention shut-off assembly for restricting the fill liquid flow through said tube when the stored liquid in the tank reaches a predetermined level and said portion being located above or below said shut-off assembly.

7. A tank according to claim 6 wherein said shut-off assembly and said control valve are substantially in vertical alignment with each other.

8. A tank according to claim 7 wherein said portion comprises an integral body having a recess with a bottom wall, intermediate wall and a top wall, said shut-off assembly having a float arm moveably mounted to said body, said float arm moveable between a fully open position in which it is positioned substantially within said recess and a restricting position in which it is positioned outside said recess and said control valve being mounted to one of the walls of said recess.

9. A tank according to claim 8 wherein said control valve is mounted to said bottom wall.

10. A method of re-filling a liquid fuel storage tank having a drop tube and a volume of residual liquid stored in the tank and drop tube to a first level and vapor filling the remainder of the tank's interior and drop tube above the first level, the method comprising:

introducing additional vapor into the remainder of the drop tube, compressing the vapor in the remainder of the drop tube, when the vapor pressure in the remainder of the drop tube reaches a predetermined positive value relative to the vapor pressure in the remainder of the tank interior, venting vapor from the remainder of the drop tube to the remainder of the tank interior at a location above the first level.

11. The method of claim 10 wherein the drop tube comprises an overflow prevention shut-off device and said venting step is located below said shut-off device.

12. The method of claim 10 further including preventing vapor flow from the remainder of the tank interior into the drop tube when the vapor pressure in the drop tube is or falls below the predetermined positive value relative to the vapor pressure in the remainder of the tank interior.

* * * * *